US007861681B2

(12) United States Patent
Manther et al.

(10) Patent No.: US 7,861,681 B2
(45) Date of Patent: Jan. 4, 2011

(54) SWITCHABLE VALVE TRAIN FOR GAS-EXCHANGE VALVES OF INTERNAL COMBUSTION ENGINES

(75) Inventors: Debra Manther, Royal Oak, MI (US); Lucian Botez, Novi, MI (US); Florin Bugescu, Canton, MI (US); Richard Best, Garden City, MI (US)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 374 days.

(21) Appl. No.: 12/036,355

(22) Filed: Feb. 25, 2008

(65) Prior Publication Data

US 2008/0289593 A1 Nov. 27, 2008

Related U.S. Application Data

(60) Provisional application No. 60/891,236, filed on Feb. 23, 2007.

(51) Int. Cl.
*F01L 1/18* (2006.01)

(52) U.S. Cl. ..... 123/90.44; 123/90.15; 123/90.16

(58) Field of Classification Search ..... 123/90.15, 123/90.16, 90.39, 90.44
See application file for complete search history.

(56) References Cited

U.S. PATENT DOCUMENTS 5,592,907 A * 1/1997 Hasebe et al. ..... 123/90.16
6,186,101 B1 * 2/2001 Kreuter ..... 123/90.15
6,325,030 B1 * 12/2001 Spath et al. ..... 123/90.16
6,470,841 B2 * 10/2002 Takahashi et al. ..... 123/90.33
7,201,125 B2 * 4/2007 Evans et al. ..... 123/90.39
7,415,954 B2 * 8/2008 Falkowski et al. ..... 123/90.39
7,530,338 B2 * 5/2009 Falkowski et al. ..... 123/90.39
7,600,498 B2 * 10/2009 Diggs ..... 123/90.39
7,603,972 B2 * 10/2009 Han et al. ..... 123/90.16

FOREIGN PATENT DOCUMENTS

DE 4238325 5/1994

OTHER PUBLICATIONS

Honda VTEC drawings, 1 page (undated) (admitted prior art).

* cited by examiner

*Primary Examiner*—Thomas E Denion
*Assistant Examiner*—Daniel A Bernstein
(74) *Attorney, Agent, or Firm*—Volpe and Koenig, P.C.

(57) ABSTRACT

A switchable valve train for gas-exchange valves of internal combustion engines with a rocker arm device (1), in which a rocking motion about a rocker arm axis (3) can be introduced by at least one cam (2*a*, 2*b*), one tappet, or the like, wherein this rocking motion can be transmitted to at least one valve (4). The rocker arm device (1) is formed from at least one cam lever part (5) in working connection with the cam (2) and a valve lever part (6) in working connection with the valve (4), which are supported so that they can rock about the rocker arm axis (3). A coupling device is constructed between the cam lever part (5) and the valve lever part (6), in order to selectively engage and disengage the transmission of the rocking motion.

10 Claims, 3 Drawing Sheets

SWITCHABLE VALVE TRAIN FOR GAS-EXCHANGE VALVES OF INTERNAL COMBUSTION ENGINES

CROSS-REFERENCE TO RELATED APPLICATIONS

This application claims the benefit of U.S. Provisional Application 60/891,236, filed Feb. 23, 2007, which is incorporated herein by reference as if fully set forth.

BACKGROUND

The present invention relates to a switchable valve train for gas-exchange valves of internal combustion engines with a rocker arm device, in which a rocking motion about a rocking arm axis can be introduced by at least one cam, tappet, or the like, wherein this rocking motion can be transmitted to at least one valve, wherein the rocker arm device is formed from at least one cam lever part in working connection with the cam and a valve lever part in working connection with the valve and the lever parts are supported so that they can rock about the rocker arm axis.

Switchable valve trains are used to turn off individual valves with respect to their activation, so that these are set predominantly out of operation as a function of the operating point of the internal combustion engine. The operation of the valves is realized by rocker arm devices executing a rocking motion about a rocker arm axis. The rocker arm device motion is introduced by a cam, tappet, or the like, into a rocker arm device, wherein in connection with the use of a cam drive, the rocker arm device has at least one part, which is in working connection with the cam, and includes another part, which is in working connection with the valve. Therefore, the rocker arm device can be divided into a cam lever part and a valve lever part, which usually have a uniform construction with respect to structure and material and thus are locked permanently to each other in rotation. The valve executes a lifting motion, which can be activated in different ways either with respect to its control times or with respect to the size of the valve lift. For this purpose there exist special cam drives, which make the valve lift variably adjustable or also the opening and closing times of the valves variable through changing the geometry of the interacting components relative to each other.

From Patent publication DE 42 38 325, a switchable valve train according to the class for gas-exchange valves of internal combustion engines is known with a rocker arm device. Here, a driving device is disclosed that can be switched on and off with drivers constructed as balls. The driving device is arranged between the rocker arm device and a tappet element, which introduces the rocking motion into the rocker arm. If the driving device is turned off, then the motion of the tappet element is not transmitted to the rocker arm. Only when the ball elements engage is there a positive-fit connection between the tappet element and the rocker arm, so that the motion is transmitted. The ball elements engage in counter contours formed in the rocker arm itself. Through the use of a locking body, the balls are held in the counter contours in the closed position, so that a positive fit is formed. The locking body, which can be activated by fluids, has a groove geometry, so that when the locking body is activated, the groove geometry can be brought into alignment with the ball elements in such a way that the ball elements engage in the groove geometry and are thus guided out of the counter contours in the rocker arm. Thus, the released position of the driving device is generated, so that the motion is no longer transmitted.

The switchable valve trains known from the state of the art have the problem that they are formed from a plurality of individual parts, wherein the arrangement of the driving device is exposed to large dynamic loads. Furthermore, the driving device is designed merely for turning a valve on and off, so that alternating activation of a valve using several cams with different constructions is not possible.

Therefore, it would be desirable to provide a switchable valve train for gas-exchange valves of internal combustion engines, wherein this valve train has a simple construction and allows the operation of a valve by various cams.

SUMMARY

The invention provides a switchable valve train for gas-exchange valves of internal combustion engines with a rocker arm device, in which a rocking motion about a rocker arm axis can be introduced by at least one cam, as well as a tappet, and the rocking motion can be transmitted to at least one valve. The rocker arm device is formed from at least one cam lever part in working connection with the cam and a valve lever part in working connection with the valve. Both levers are supported so that they can rock about the rocker arm axis. According to the invention, a coupling device is formed between the at least one cam lever part and the valve lever part in order to selectively engage or disengage the transmission of the rocking motion.

The invention starts from the idea to construct the rocker arm device comprising the valve lever part and the cam lever part in two parts, so that the rocker arm part can be selectively disengaged or engaged by the cam lever part. In this way, a switchable valve train is created, which allows the operation of a valve to be arbitrarily set out of operation and placed back in operation by disengaging the valve lever part from the cam lever part. If the valve is set out of operation, only the cam lever part executes a rocking motion, because this is driven permanently by the cam, tappet, or the like. However, the motion is not transmitted to the valve lever part, because the coupling device separates the motion of the cam lever part from the valve lever part. Only when the coupling device is closed again is the rocking motion transmitted again to the valve lever part and can the valve be set in operation again. Both the rocking motion of the cam lever part and also the rocking motion of the valve lever part are realized about the rocker arm axis, so that both parts are arranged concentric with respect to the rocker arm axis itself.

Advantageously, the coupling device can be activated by fluids. The fluid activation can be realized either through the use of compressed oil, wherein pneumatic activation also represents a possible variant. Here, it is possible to design the coupling device in such a way that the valve is set out of operation when the fluid pressure is fed to the coupling device and the valve is placed in operation again only when the fluid pressure is reduced.

Another advantageous embodiment of the coupling device includes at least one clamping body, which can move between an engaged position and a released position. The clamping body is advantageously constructed as a ball element and is inserted into a receptacle borehole, which is formed in the radial direction in the valve lever part. The radial orientation of the receptacle borehole describes a path of the borehole, which is arranged perpendicular, i.e., orthogonal to the rocker arm axis. The assumption of the engaged position or the released position of the ball element is here realized by a motion of the ball element in the radial direction within the receptacle borehole.

Advantageously, it is provided that the ball element can move outward in the radial direction in the receptacle borehole for assuming the engaged position and this engages in a pocket-shaped recess formed in the cam lever part, in order to create a positive fit for transmitting the rocking motion between the cam lever part and the valve lever part. In the engaged position, the valve lever part is locked in rotation with the cam lever part, wherein the connection is broken in the released position. The pocket-shaped recess is formed on the inside in the cam lever part, so that the ball element can move deep into the pocket-shaped recess in such a way that an adequate positive fit is created, in order to transmit the rocking motion. Should the transmission be broken, the ball element is guided out of the pocket-shaped recess again, so that the positive fit is canceled.

Another advantageous embodiment provides that at least one cam lever part and one valve lever part are supported so that they can rock on a common support shaft which extends about the rocker arm axis. The ball element here borders, on the inside in the radial direction, an adjustment piston, which has a sleeve-like shape and which encloses the receptacle shaft in the radial direction. The adjustment piston is formed in the shape of a sleeve, which is guided on the support shaft in a sealed way. The adjustment piston interacts with the ball elements and can offset the ball elements in the radial direction due to its geometric construction of the outer periphery.

This is realized by at least one groove geometry formed on the periphery in the adjustment piston, in which an allocated ball element can move inward in the radial direction, in order to detach the positive fit for transmitting the rocking motion between the cam lever part and the valve lever part, wherein the alignment of the groove geometry with the ball element is realized by an axial displacement of the adjustment piston. Through the radial movement of the ball elements, these can be formed either within the pocket-shaped recess or the ball elements are formed in the groove geometry, which is located on the periphery on the adjustment piston. In this way, the pocket-shaped recess in the cam lever part and the groove geometry in the adjustment piston stand opposite each other only in the released position, so that the ball element is moved into the groove geometry. If the adjustment piston is shifted in the axial direction, then the groove geometry and the pocket-shaped recesses no longer stand opposite each other, so that the ball element is pressed into the pocket-shaped recess, in order to form the positive fit. Thus, the engaged position is achieved and the valve is set in operation by the associated cam.

Advantageously, the adjustment piston borders, with an axial end face, a pressurized medium chamber formed in the valve lever part, wherein the adjustment piston can be moved in the axial direction of the rocker arm axis against a restoring spring by pressurizing the pressurized medium chamber. Through the arrangement of the pressurized medium chamber on one side of the adjustment piston and the pressing of the restoring spring on the opposite side of the adjustment piston, a monostable arrangement of the adjustment piston is created, so that when the pressurized medium chamber is pressurized, the adjustment piston is moved against the force of the restoring spring. In this way, the pressurized position of the adjustment piston can represent either the engaged position or the released position.

It is advantageous that two cam lever parts, which each can be locked in rotation with the valve lever part by a coupling device for the selective transmission of the rocking motion of the first cam lever part or the second cam lever part, are allocated to one valve lever part. The selective force transmission either of a first cam lever part or a second cam lever part is performed by the presence or absence of pressurization, so that a first coupling device engages or disengages between the valve lever part and the first cam lever part or a second cam lever part can be selectively connected to the valve lever part by a second coupling device, which also selectively engages or disengages.

One advantageous improvement of the invention includes pressurized medium chambers, which can be pressured using fluids via fluid supply channels, wherein for simultaneous pressurization of each pressurized medium chambers, a first adjustment piston can be brought into a closed position and a second adjustment piston can be brought into an opened position. If both pressurized medium chambers, which border the relevant adjustment piston, are pressurized, then the first adjustment piston is located in a closed position and the second adjustment piston is located in an opened position. This can be achieved, for example, in such a way that in the corresponding monostable arrangement of the adjustment piston, the position of the peripheral groove geometry is arranged in such a way that this position is aligned with the pocket-like recess for the first adjustment piston and not aligned in the second arrangement when pressurized.

Advantageously, two, three, four, or more ball elements and correspondingly allocated receptacle boreholes are arranged with equal spacing with respect to each other on the periphery of the coupling device. The invention, however, is not limited to a triple arrangement of the ball elements in the correspondingly allocated receptacle boreholes, but instead one ball element, two ball elements, three ball elements, or any arbitrary number of ball elements can be provided in correspondingly allocated receptacle boreholes. Here, equal distribution of the ball elements is also not absolutely necessary, so that the relevant distances of the ball elements with respect to each other can also be constructed differently.

It is further advantageous that different lift information is stored in the first cam interacting with the first cam lever part than in the second cam interacting with the second cam lever part, so that different valve control times and/or valve lifts can be set by the selective switching of the working connection of the valve lift part to the first or second cam lever part. In this way, it can be achieved that different valve control times and/or valve lifts can be set by the selective switching of the working connection of the valve lever part to the first or alternatively to the second cam lever part. Different valve lifts can be generated by cam geometries of different sizes, wherein different valve control times determine the peripheral position of the cam on the camshaft. Thus, either a first valve control time with a first valve lift or selectively a second valve control time with a larger or smaller valve lift can be set as a function of the operating mode or the operating point of the internal combustion engine. In this way, the valve control time of the valve in operation can be adapted to the operating point of the internal combustion engine at least in a two-stage form.

It is further advantageous that the valve lever part is in a force transferring arrangement selectively with the first cam lever part, with the second cam lever part, or with none of the cam lever parts, in order to create a valve shutdown. Thus, the relevant valve can be turned off, which can bring advantages depending on the operating point and the load state of the internal combustion engine. Furthermore, the adjustment piston can be activated using fluid pressure, such as compressed oil, or by an electrically operated actuator, such as an electromagnet, in order to be above to use corresponding advantages of the different operating types.

Other measures improving the invention are described in more detail below together with the description of a preferred embodiment of the invention with reference to the figures.

BRIEF DESCRIPTION OF THE DRAWINGS

A preferred embodiment of the invention is described in further detail below in connection with the appended drawing figures. In the drawings.

DETAILED DESCRIPTION OF THE PREFERRED EMBODIMENTS

Figure 1:
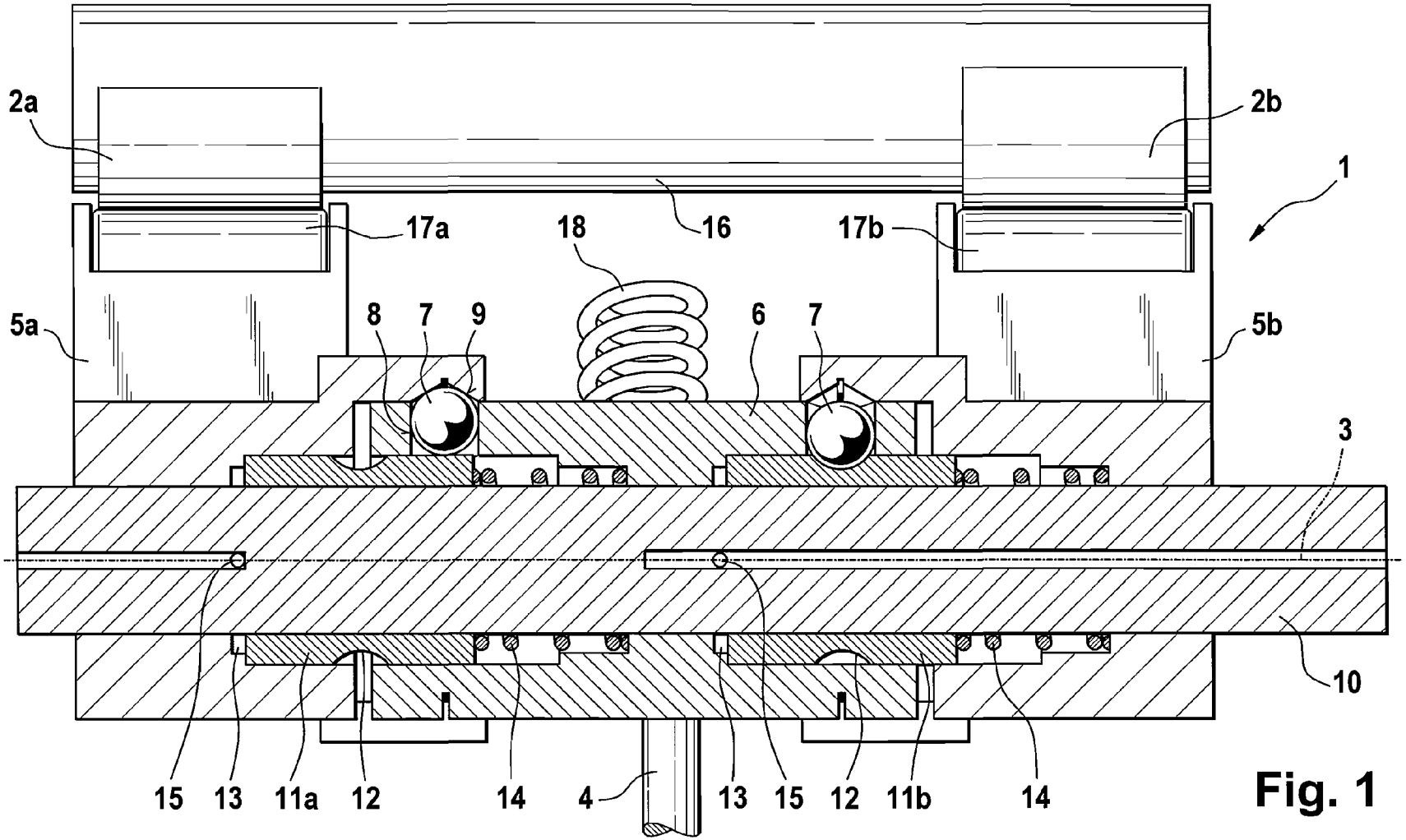
FIG. 1 is a cross-sectional side view of a rocker arm device according to the present invention with a valve lever part, on which both a first cam lever part and also a second cam lever part are arranged adjacent to the sides.

The rocker arm device 1 in FIG. 1 extends about a rocker arm axis 3 and is supported on a support shaft 10. The rocker arm device 1 is excited by the cam 2*a* and 2*b*, which are arranged on a rotating camshaft 16. The cam 2*a* is shown on the left side and the cam 2*b* on the right side. As can be seen, roller elements 17*a* and 17*b* pick up the lift information from the associated cams 2*a* and 2*b* and set a corresponding cam lever part 5*a* or 5*b*, in which the allocated roller elements 17*a* and 17*b* are formed, into a rocking motion. This rocking motion is realized about the rocker arm axis 3, so that the cam lever parts 5*a* and 5*b* are supported on the support shaft 10 so that they can rotate. Not-shown return-stroke springs move the corresponding cam lever parts 5*a* and 5*b* against the cams 2*a* and 2*b*. Between the two cam lever parts 5*a* and 5*b* there is a valve lever part 6, wherein a corresponding coupling device is arranged between the valve lever part 6 and the left-side cam lever part 5*a* and also the right-side cam lever part 5*b*. The coupling device allows the cam lever parts 5*a* or 5*b* either to be locked in rotation with the valve lever part 6 or for the connection to be separated, so that the rocking motion of the cam lever part 5*a*, 5*b* is not transmitted to the valve lever part 6. The valve lever part 6 interacts with the valve 4, with the restoring motion of the valve lever part 6 being performed by a restoring spring 18.

The coupling devices are constructed in such a way to lock the cam lever parts 5*a* and 5*b* in rotation selectively with the valve lever part 6, so that the rocking motion is transmitted to the valve 4. This is performed by corresponding ball elements 7, which generate a positive fit between the lever parts 5 and 6. A coupling device, which includes the ball element 7 located in a pocket-like recess 9 formed in the cam lever part 5, is shown on the left side. Furthermore, because the ball element 7 is formed within a receptacle borehole 8 in the valve lever part 6, a positive fit is created between the cam lever part 5*a* and the valve lever part 6. In the section plate, only a single ball element 7 is shown, wherein, according to the present embodiment for each coupling device, there are three ball elements 7 arranged distributed equally about the periphery.

On the inside, the ball element 7 according to the Figure borders a first adjustment piston 11*a*, wherein the outer contours of the adjustment piston 11*a* presses the ball element 7 into the recess 9. In this way, the adjustment piston 11*a* is located in a closed position, so that the ball element 7 is engaged and a rotational motion or rocking motion of the cam lever part 5*a* is transmitted to the valve lever part 6. Consequently, according to the Figure the valve 4 is set into a lifting motion by the cam 2*a*.

The right-side coupling device, which allows the cam lever part 5*b* to be connected to the valve lever part 6, is located in a released position. The ball element 7 is not pressed into the pocket-shaped recess 9 within the cam lever part 5*b*, so that no positive fit is generated. In this way, the cam lever part 5*b* can move in a rocking motion about the rocker arm axis 3, wherein the motion is not transmitted to the valve lever part 6. Leading the ball element 7 out of the pocket-shaped recess 9 is performed by a geometric construction of the adjustment piston 11*b*, which includes a groove geometry 12 arranged on the peripheral side, in which the ball element 7 can engage. If the groove geometry 12 is brought into alignment with the pocket-shaped recess 9 within the camshaft part 5*b* through axial displacement of the adjustment piston 11*b*, then the ball element 7 is led out of the pocket-shaped recess 9 and the positive-fit connection is disengaged.

The axial displacement of the adjustment piston 11 is realized by pressurized medium chambers 13, which border this piston on the end and which can be pressurized by fluid supply channels 15. The geometries of the adjustment piston 11*a* and 11*b*, however, are created differently in such a way that when the adjustment piston 11*a* is pressured by fluid, the ball element 7 is transmitted into a released position, wherein when the adjustment piston 11*b* is pressured by fluid, the associated ball element 7 is pressed into the pocket-shaped recess 9, so that the engaged position is created. The adjustment pistons 11*a* and 11*b* are shown in a monostable arrangement, wherein for the return motion, a restoring spring 14 presses the adjustment pistons 11*a* and 11*b* in the direction of the pressurized medium chambers 13.

Figure 2:
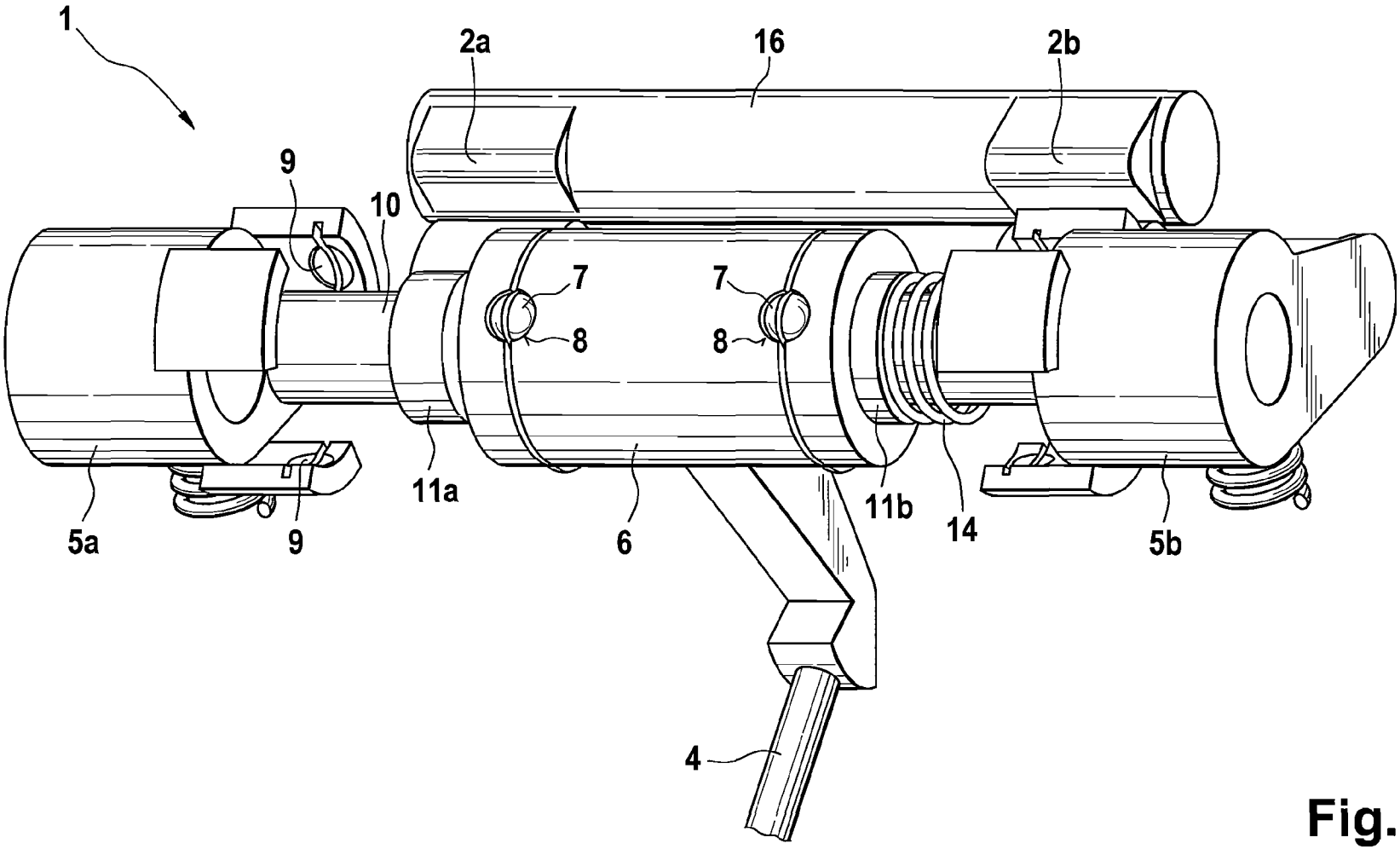
FIG. 2 is a perspective view of the rocker arm device, wherein the cam lever parts and the valve lever parts are shown in a position separated from each other.

FIG. 2 shows a perspective view of the rocker arm device 1, wherein, in turn, the cams 2*a* and 2*b* are shown, which are arranged on the camshaft 16. According to the representation it is clearly visible that the cam 2*a* shown on the left side has a smaller construction than the right-side cam 2*b*. In this way, a smaller lifting motion in the valve 4 is generated by the left-side cam 2*a* than by the cam 2*b* on the right side. The cam 2*b* interacts with the valve 4 via a rotationally locked connection of the cam lever part 5*b* with the valve lever part 6, wherein for the working connection of the cam 2*a* with the valve 4, the cam lever part 5*b* must engage with the valve lever part 6, in order to transmit the rotational motion. Due to the exploded view, the components are shown separated from each other, so that in the cam lever part 5*a*, the pocket-shaped recesses 9 are clearly visible. It is further visible that the support shaft 10 holds both the cam lever parts 5*a* and 5*b* and also the valve lever part 6. Within the valve lever part 6, receptacle boreholes 8 are formed, in which ball elements 7 are arranged. These interact, on the inside, with the adjustment pistons 11*a* and 11*b*, wherein the adjustment pistons can be displaced in the axial direction, in turn, by associated restoring springs 14.

Figure 3:
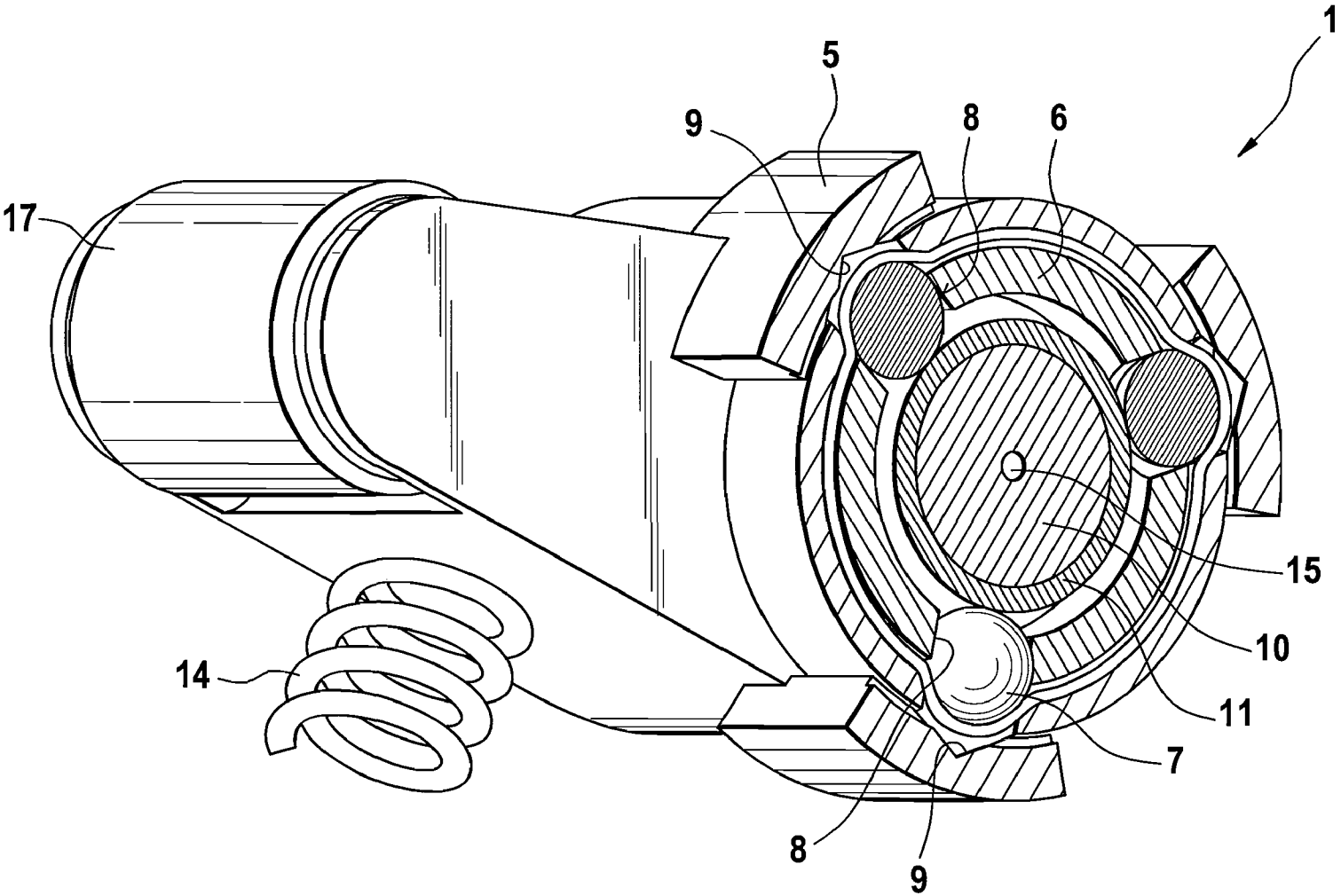
FIG. 3 is a perspective view of a part of a rocker arm device with a cam lever part, within which the coupling device according to the invention is shown.

FIG. 3 shows a detailed view of the arrangement of the ball elements 7 within the valve lever part 6. Furthermore, the pocket-shaped recesses 9 are shown, which are formed in the cam lever part 5. According to the representation, the ball elements 7 are located in an engaged position, so that a rotational movement between the cam lever part 5 and the sectioned and therefore only partially shown valve lever part 6 is transmitted. Both lever parts 5 and 6 are supported on a receptacle shaft 10 so that they can rotate, which is also shown in section. Clearly visible is the annular adjustment piston 11, which encloses the support shaft 10 on its full periphery. A restoring spring 18 is used for restoring the cam lever part 5 against a cam—not shown here in more detail—which is in working connection with the roller element 17 as a pick-up element.

The invention is not limited in its construction to the preferred embodiment specified above. Instead, a number of variants are conceivable, which make use of the described solution also for fundamentally differently shaped constructions. Thus, the geometry of the clamping bodies is not limited to a ball geometry, but instead all possible different geometries are conceivable. For example, cylinder pins are one possible alternative to a ball-shaped clamping body, so that the cylinder pins can engage in similarly cylindrical pocket-like recesses 9. Furthermore, the adjustment piston 11 can also feature a conical shape or the like as an alternative to a groove geometry 12, in order to press the clamping body into the recess over the cone angle.

LIST OF REFERENCE SYMBOLS

1 Rocker arm device
2 Cam
3 Rocker arm axis
4 Valve
5 Cam lever part
6 Valve lever part
7 Ball element
8 Receptacle borehole
9 Pocket-shaped recess
10 Support shaft
11 Adjustment piston
12 Groove geometry
13 Pressurized medium chamber
14 Restoring spring
15 Fluid supply channel
16 Camshaft
17 Roller element
18 Restoring spring

The invention claimed is:

1. Switchable valve train for gas-exchange valves of internal combustion engine, comprising a rocker arm device, in which a rocking motion about a rocker arm axis can be introduced by at least one cam or tappet, the rocking motion is transmittable to at least one valve, the rocker arm device includes at least one cam lever part in working connection with the cam and a valve lever part in working connection with the valve, which are supported so that the lever parts can rock about the rocker arm axis, a coupling device, which includes at least one clamping body, comprising a ball element and held in a receptacle borehole formed in a radial direction in the valve lever part, which can move between an engaged position and a released position, is located between the at least one cam lever part and the valve lever part, and is moveable between at least first and second positions to selectively engage or disengage a transmission of the rocking motion.

2. Switchable valve train according to claim 1, wherein the ball element can be moved outward in the radial direction for assuming the engaged position in the receptacle borehole and the ball element engages in a pocket-shaped recess formed in the cam lever part, in order to create a positive fit for transmitting the rocking motion between the cam lever part and the valve lever part.

3. Switchable valve train according to claim 1, wherein the at least one cam lever part and the valve lever part are held on a support shaft extending about the rocker arm axis so that the lever parts can rock, and the ball element borders an adjustment piston on an inside in the radial direction, which has a sleeve-like construction and which encloses the support shaft in the radial direction.

4. Switchable valve train according to claim 3, wherein the adjustment piston includes at least one groove geometry, which is formed on a periphery and in which an associated ball element can move inwardly in the radial direction, in order to disengage the positive fit for transmitting the rocking motion between the cam lever part and the valve lever part, wherein an alignment of the groove geometry with the ball element is realized via an axial displacement of the adjustment piston.

5. Switchable valve train according to claim 4, wherein the adjustment piston borders, with an axial end face, a pressurized medium chamber formed in the valve lever part and the adjustment piston can move in the axial direction in a direction of the rocker arm axis against a restoring spring by pressurization of the pressurized medium chamber.

6. Switchable valve train according to claim 5, wherein the at least one cam lever part comprises first and second cam lever parts that are allocated to the one valve lever part, the cam lever parts can each be locked in rotation with the valve lever part by a coupling device for selective transmission of the rocking motion of the first cam lever part or the second cam lever part.

7. Switchable valve train according to claim 6, wherein there are two pressure medium chambers and for pressurizing the pressurized medium chambers with fluid, fluid supply channels are provided in the support shaft, wherein when the pressurized medium chambers are pressurized simultaneously, a first adjustment piston can be brought into a closed position and a second adjustment piston can be brought into an opened position, wherein the valve lever part is in force transmitting connection selectively with the first cam lever part, with the second cam lever part, or with none of the cam lever parts, in order to create a valve shutdown.

8. Switchable valve train according to claim 7, wherein at least two of the ball elements and a corresponding number of the associated receptacle boreholes are arranged spaced equally relative to each other on the periphery of the coupling device.

9. Switchable valve train according to claim 6, wherein different lift information is stored in a first one of the cams interacting with the first cam lever part than in a second one of the cams interacting with the second cam lever part, so that different valve control times and/or valve lifts are adjustable by the selective switching of the working connection of the valve lever part with the first or with the second cam lever part.

10. Switchable valve train according claim 7, wherein the adjustment pistons are activated by pressurization with fluid or by an electrically activated actuator.

* * * * *